US005257472A

United States Patent [19]

Harnois et al.

[11] Patent Number: 5,257,472

[45] Date of Patent: Nov. 2, 1993

[54] IMPROVED SIGN BOARD HAVING A CONTAINER FOR HOLDING A STACK OF SHEETS

[76] Inventors: Yves Harnois, 8045 Châteauvert, Trois-Rivieres, Quebec, Canada, G8Y 6V6; André Bareil, 230 Masson, Cap-de-la-Madeleine, Quebec, Canada, G8W 1R4

[21] Appl. No.: 738,151

[22] Filed: Jul. 30, 1991

[51] Int. Cl.[5] ..... G09F 7/00

[52] U.S. Cl. ..... 40/606; 40/618; 40/607

[58] Field of Search ..... 40/490, 649, 657, 124, 40/606, 607, 608, 611; 206/39, 39.5, 455, 456, 555; 248/221.4, 468, 473, 126; 24/635, 587

[56] References Cited

U.S. PATENT DOCUMENTS

| | | | |
|---|---|---|---|
| 2,114,767 | 4/1938 | Hodny et al. | 248/473 |
| 2,262,058 | 11/1941 | Sinclair | 40/649 |
| 3,148,469 | 9/1964 | Umanoff | 40/5 |
| 3,809,799 | 5/1974 | Taylor | 248/221.9 |
| 3,890,728 | 6/1975 | Schubert | 40/611 |
| 4,301,917 | 11/1981 | Ancell | 206/39.5 |
| 4,310,091 | 1/1982 | Hara et al. | 40/490 |
| 4,884,351 | 12/1989 | Abramson | 40/611 |
| 4,899,886 | 2/1990 | Johansen | 206/39.5 |

FOREIGN PATENT DOCUMENTS

| | | |
|---|---|---|
| 1223441 | 6/1987 | Canada . |
| 843498 | 7/1952 | Fed. Rep. of Germany . |

*Primary Examiner*—Kenneth J. Dorner
*Assistant Examiner*—Cassandra Davis
*Attorney, Agent, or Firm*—Collard & Roe

[57] ABSTRACT

A container is useful in a sign board in which certain display elements have to be changed from time to time. The container is provided with element for preventing a stack of display sheets contained therein from accidentally slipping out. There is a sign board in which at least certain elements have to be changed from time to time, and these elements are housed in one or several of these containers. These containers are positioned and locked, on at least one face of a flat body which is part of the sign board, between a pair of parallel guiding bars connected to the body. The sign board can be provided with element for removably fastening it to a base in order to keep the sign board in a substantially vertical position.

4 Claims, 4 Drawing Sheets

IMPROVED SIGN BOARD HAVING A CONTAINER FOR HOLDING A STACK OF SHEETS

FIELD OF THE INVENTION

The invention relates to an improved container, especially a container of the type intended to be used in a sign board, in which certain display elements have to be changed from time to time, and provided with means preventing a stack of display sheets contained therein to accidentally slip out from it.

The invention also relates to a sign board in which at least certain elements have to be changed from time to time, said elements being housed in one or several containers of the type mentioned hereinbefore. These containers are positioned and locked, on at least one face of a flat body which is part of the sign board, between a pair of parallel guiding bars connected to said body.

The invention further relates to a sign board of the type provided with improved means for removably fastening it with a base in order to keep the sign board into a substantially vertical position.

BACKGROUND OF THE INVENTION

As already stated in Applicant's Canadian patent No. 1,223,441 (issued on Jun. 30, 1987), sign boards are used in public places, such as stores, banks and the like, to display advertizing and messages, the elements of which must be changed from time to time, for instance the price of certain items to be sold or the interest rate available in a bank.

Even though Applicant's Canadian patent No. 1,223,441 solved several problems that were encountered with former sign boards, namely the use of display elements that were either complex and expensive to manufacture or did not obey with fundamental rules for graphic arrangement of said display elements, some problems were left unsolved. Amongst these unsolved problems, it may be cited the followings:

When a sign board, for example a sign board of the type described in Canadian patent No. 1,223,441, U.S. Pat. No. 3,148,469 or German patent No. 843,498 is accidentally dropped on a floor (especially when display sheets are changed (i.e. the optional locking strip of Canadian patent No. 1,223,441 or the top wall of U.S. Pat. No. 3,148,469 being removed)), stacks of display sheets may slip out from their corresponding pockets and become mixed together or some display sheets may be lost. Such an accident may make the sign board expensive to use because an employee has to spend time to reform stacks of display sheets, or may become useless because some display sheets are lost.

In sign boards of the prior art, such as the sign boards of Canadian patent No. 1,223,441, U.S. Pat. No. 3,148,469 or German patent No. 843,498, pockets in which stacks of display sheets are housed, are in a fixed relationship one with respect to the other. Therefore, they cannot be moved one with respect to the other when it is required to center an advertising or a message in order to meet with fundamental rules for graphic arrangement.

In sign boards of the prior art, means may be provided in order to keep them into a substantially vertical position. For example, in U.S. Pat. No. 3,148,469, projecting edges and springy wire elements of a display device may be engaged between a pair of opposite grooves of a metal molding strip that is secured on the front edge of a shelf. Also, in German patent No. 843,498, needles may be secured on a box. However, none of prior art sign boards were provided with means allowing to easily and removably connect them with a base adapted to rest on a substantially horizontal surface or element, in order to keep said sign boards into a substantially vertical position.

OBJECTS OF THE INVENTION

A first object of the present invention relates to an improved container, especially a container of the type intended to be used in a sign board, in which certain display elements have to be changed from time to time and provided with means allowing to prevent a stack of display sheets contained therein to accidentally slip out from it.

Another object of the present invention relates to an improved container that is of a simple and inexpensive construction, and is easy to use.

Another object of the present invention relates to an improved sign board which obviates drawbacks noted with sign boards of the prior art, while obeying the rules of graphic art. More particularly, the invention relates to a sign board of the type in which at least certain elements have to be changed from time to time, said elements being housed in one or several containers of the type mentioned hereinbefore. These containers are positioned and locked, on at least one face of a flat body which is part of the sign board, between a pair of parallel guiding bars connected to said body.

Another object of the present invention relates to an improved sign board that is of a simple and inexpensive construction, and is easy to use.

Another object of the present invention relates to a sign board of the type provided with improved means for removably connecting it with a base in order to keep said sign board into a substantially vertical position. More particularly, the base is adapted to rest on a substantially horizontal surface or on a substantially horizontal element.

Another object of the present invention relates to a sign board, especially an aforesaid improved sign board of the type provided with improved means for fastening it with a base, that is still of a simple and inexpensive construction, obeys with the rules of graphic art, and is easy to use.

SUMMARY OF THE INVENTION

The invention relates to an improved container, especially a container of the type intended to be used in a sign board, comprising a substantially flat front wall provided with a window, a substantially flat rear wall, and side walls connecting together the front wall and the rear wall and positioning them at a distance from each other and thus define a pocket. Between the front and the rear walls is positioned an access opening to the pocket. A stack of individual display sheets is housed in the pocket, all sheets being of the same size and conforming to the size of the associated pocket. One, several or all the sheets are insertable in or removable from said pocket through the access opening. In normal use, the foremost display sheet of the stack is visible through the window while the other display sheets of the stack are hidden from view by the foremost display sheet. All the display sheets of a stack are interchangeable so that any selected display sheet of such a stack can be positioned in the foremost position. This container is improved in that means for engaging (preferably pinching) the stack of display sheets inside the pocket are provided, in order to prevent said display sheets to accidentally slip out from the pocket through the access opening.

The invention also relates to an improved sign board assembly of the type comprising:

a flat body provided with at least one pair of guiding bars that are spaced apart and substantially parallel to each other, and have a part thereof spaced apart from one face of the body and another part thereof connected with to face of the body, in order to define a pair of grooves facing to each other;

one or several containers (preferably from 2 to 4 containers), as defined hereinabove, each of said containers being sized to have parts thereof slidable between the flat body and the pair of guiding bars and have at least a part thereof supported on the lower guiding bar of said pair of guiding bars; and means for removably preventing said containers to slid between the flat body and the guiding bars and thus lock said containers in position on a corresponding face of the flat body.

The invention further relates to a sign board, especially an improved sign board of the type defined hereinabove, provided with improved means for removably connecting a lower end thereof with a base intended to rest on a substantially horizontal surface (e.g. a table) or on a substantially horizontal element (e.g. a pole), in order to keep the sign board into a substantially vertical position.

More particularly, according to another embodiment, the invention relates to an improvement in any kind of sign boards of the type comprising:

a flat body having a lower end and being adapted to support at least one display sheet, a base having a top surface and being adapted to be positioned on a substantially horizontal surface or element in order to keep the flat body in a substantially vertical position, and means for fastening the top surface of said base with the lower end of the flat body.

These improved means may consist of at least two pairs of substantially parallel shoulders:

said shoulders of a first pair of shoulders being spaced apart from each other, and being respectively located on opposite and substantially parallel faces of the sign board, near a lower end thereof, said shoulders of a second pair of shoulders being spaced apart from each other and respectively located on a pair of substantially parallel walls integrally extending above (preferably from and above) the base (especially a substantially horizontal surface of the base), each shoulder of the first pair of shoulders being engageable against and slidable over a corresponding shoulder of the second pair of shoulders when the lower end of the sign board is engaged against and slidable over the base (especially the substantially horizontal surface of the base).

The invention will be better understood with reference to the following non restrictive description of preferred embodiments thereof, make with reference to the following drawings:

DETAILED DESCRIPTION OF PARTICULARLY PREFERRED EMBODIMENTS OF THE INVENTION

Figure 1:
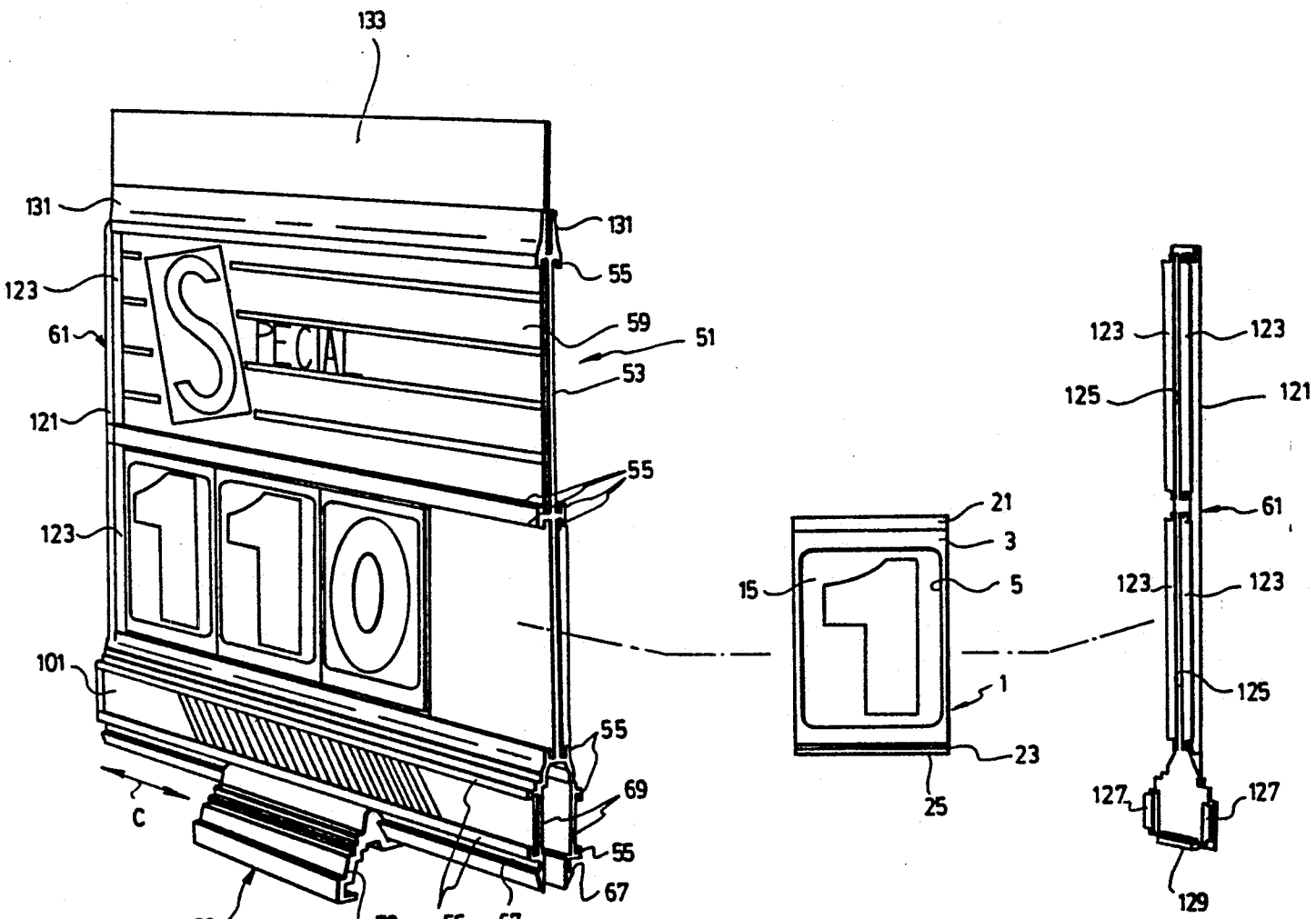
FIG. 1 is a partially exploded view of an improved sign board according to the invention, with a first preferred embodiment of an optional base.
Figure 2:
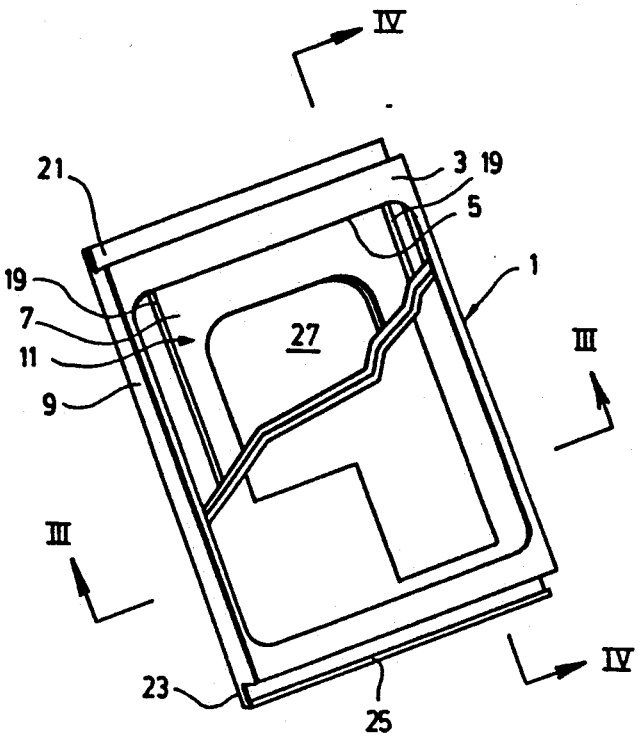
FIG. 2 is a perspective view of an improved container according to the invention (a part of the stack of display sheets being not represented in order to show details of the pocket)
Figure 3:
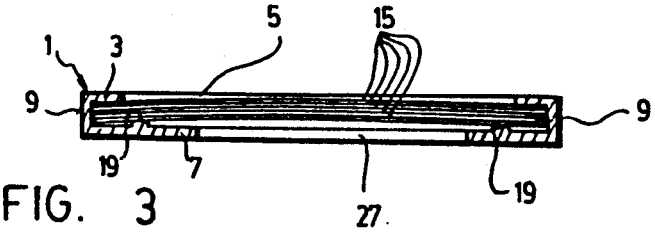
FIG. 3 is a cross-sectional view according to III—III of the container of FIG. 2.
Figure 4:
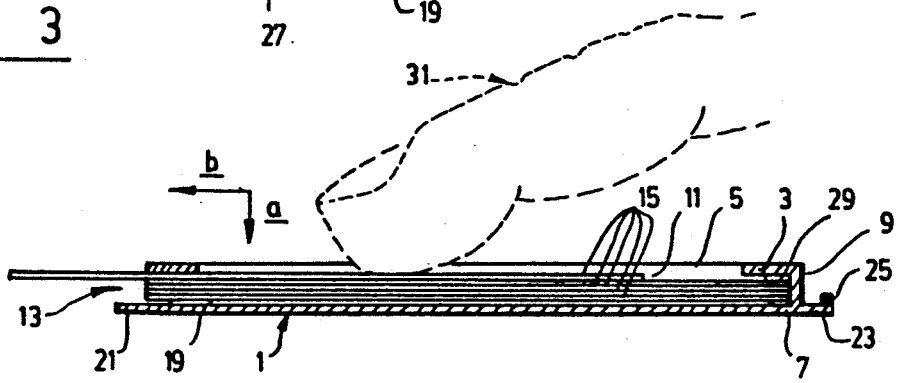
FIG. 4 is a cross-sectional view according to IV—IV of the container of FIG. 2.

FIGS. 2 to 4 relates to a first particularly preferred embodiment of the invention, that is an improved container 1, especially a container 1 intended to be used in a sign board of the type shown in FIG. 1. This container 1 comprises a pocket 11 which is defined by a substantially flat front wall 3 provided with a window 5, a substantially flat rear wall 7, and side walls 9 connecting walls 3 and 7 together and keeping them at a distance from each other.

The container 1 is further provided with an access opening 13 to the pocket 11. This access opening 13 is positioned between the walls 3 and 7.

The container 1 is also provided with a stack of individual display sheets 15, all of the same size, conforming with the size of the pocket 11. This stack is insertable in the pocket 11 and removable from the pocket 11 through the access opening 13. For example, the stack may consist of five cardboard or plastic sheets defining ten faces on which numbers from 0 to 9, or any other appropriate symbols, are respectively printed.

When the slack of display sheets 15 is inserted in the pocket 11, the foremost display sheet of the stack is visible through the window 5 while other display sheets of the stack are hidden from view by the foremost display sheet. All the display sheets 15 of the stack are interchangeable, so that any selected display sheet can be positioned in the foremost position.

The improvement to aforesaid preferred embodiment of a container according to the invention consist of providing means for engaging (preferably pinching) the stack of display sheets 15 inside the pocket 11 in order to prevent said sheets to accidentally slip out from the pocket 11 through the access opening 13.

Preferably, means for pinching the stack of display sheets inside the pocket may consist of at least one protuberance integral with the pocket and making the distance existing between the protuberance and a plane coplanar with an inner surface of the front or rear wall, slightly lesser than a thickness of the stack. Thus the stack of display sheets is pinched between the protuberance and the inner surface of a corresponding wall.

According to a particularly preferred embodiment of the invention, as illustrated in FIGS. 2 to 4, means for pinching the stack of display sheets 15 inside the pocket 11 consists of a pair of parallel ribs 19 integral with the rear wall 7 and advantageously substantially perpendicular with the access opening 13 and under and close the periphery of the window 5. Each rib 19 defines a protuberance making the distance existing between it and a plane coplanar with an inner surface of the front wall 3, slightly lesser than a thickness of the stack of display sheets 15. Thus the stack of display sheets 15 is pinched between ribs 19 and the inner surface of the front wall at the periphery of the window 5 to make the stack slightly bowed toward the window 5 (see FIG. 3).

According to another particularly preferred embodiment of the invention, as illustrated in FIGS. 2 to 4, the rear wall 7 is further provided with a pair of opposite short tongues 21,23. The tongue 21 integrally extends one end of the rear wall 7 that is located near the access opening 13. The tongue 23 integrally extends one end of the rear wall 7 that is opposite the access opening 13. Advantageously, the tongue 23 may be thickened at its end to define a skid 25. The tongue 23 is normally defining a lower end of the container 1 while the access opening 13 is located at the top of the pocket 11.

Of course, the distance between a protuberance (preferably ribs 19) and a plane coplanar with the inner surface 29 of the front wall 3 is selected to be slightly lesser than a thickness of a stack of individual display sheets to be inserted in the pocket 11. Thus, even though the container 1 is turned upside down (i.e. access opening oriented downwardly), and eventually dropped on a floor, the stack of display sheets will remain within the pocket 11.

The container 1 may be made, preferably, of any appropriate plastic material, and obtained by any appropriate technique such as moulding.

For removing one, several or all the display sheets 15 from the pocket 11 through the access opening 13, one just have to apply pressure (according to arrow a) against the stack of display sheets 15 with his finger 31 and push (according to arrow b) the display sheets 15 one after the other outside the pocket 11 through the access opening 13. Optionally, when the rear wall 7 is further provided with an opening 27, the whole stack of display sheets 15 may be grasped between one's thumb and index and pushed through the access opening 13. It is just necessary that the force applied in the direction of arrow b be greater than the force of friction existing between the stack of display sheets 15, and the protuberance (preferably ribs 19) and the inner surface 29.

Figure 5:
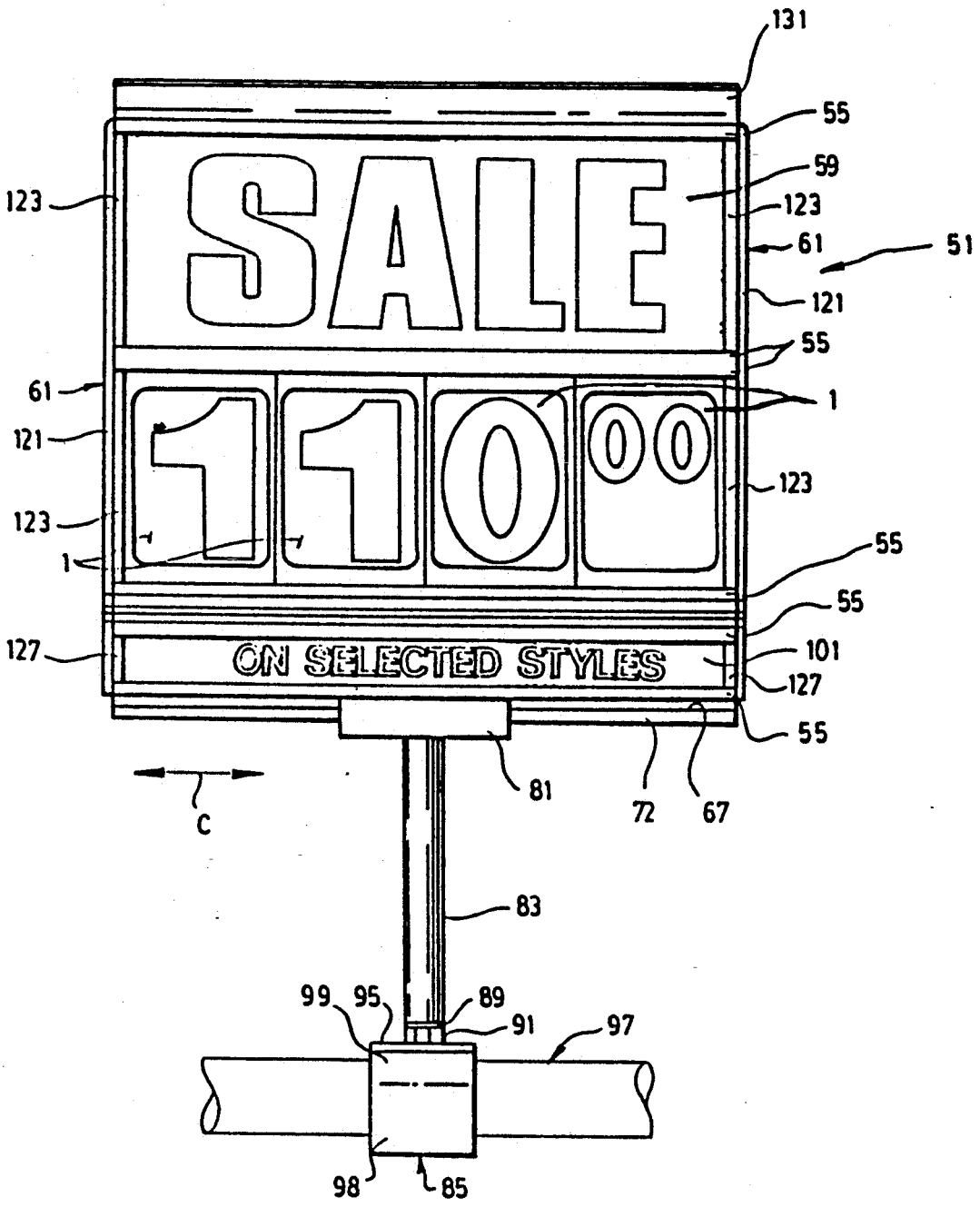
FIG. 5 is a front elevational view of the sign board of FIG. 1 with a second preferred embodiment of an optional base.

According to a second particularly preferred embodiment, the invention relates to an improved sign board 51, as illustrated in FIGS. 1 and 5. This sign board comprises:

a flat body 53 provided on at least one face thereof and preferably on each face thereof, with one and optionally two or three pairs of guiding bars 55 spaced apart and parallel to each other, each pair of guiding bars having a part thereof spaced apart from a corresponding face of the body 53 and another part thereof connected to a corresponding face of the flat body 53 so as to define a pair of grooves 57 facing to each other;

four containers 1, as defined hereinabove with reference to FIGS. 2 to 4, on at least one face of the flat body 53 and preferably on each face of the flat body 53. Each of said containers 1 is sized to have parts thereof (preferably tongues 21,23), slidable between the flat body 53 and a corresponding pair of guiding bars 55, and have a part thereof (preferably the skid 25) supported on a corresponding part of the lower corresponding guiding bar 55;

means for removably preventing said containers 1 to slid between the flat body 53 and the guiding bars 55, to thus removably lock them in position on a corresponding face of the flat body 53.

Advantageously, each guiding bar 55 consists of an elongated strip of material having a "L" shaped cross section and having one of its stem integral with one face of the flat body 53, and the other stem extending at a substantially constant distance from the corresponding face of the flat body 53, in order to define for each guiding bar 55, a groove 57. Of course, for a same pair of guiding bars 55, grooves 57 are oriented one toward the other.

Optionally, as illustrated in FIGS. 1 and 5, when two pairs of guiding bars are provided on a same face of the body 53, two adjacent guiding bars having a "L" shaped cross section and belonging to distinct pair of guiding bars on a same face of the body 53, may be integral to each other to define a guiding bar having a "T" shaped cross section. In that case, for example, it may be possible to directly position between grooves 57 of second pair of guiding bars 15, a stack of display sheets 59. However, that stack of display sheets 59 may be housed, if desired, in a container similar to the container 1 but of larger width.

Optionally, the face of each wall 69 may be provided with a pair of guiding bars 55 identical to the one defined hereinabove. In that case, it may be possible to directly position between grooves 57 of each pair of guiding bars 55 a stack of display sheets 101. Of course, that stack of display sheets 101 could be housed in a container similar to the container 1 but smaller in height and larger in width.

Means for removably preventing container 1 to slid freely between the flat body 53 and the guiding bars 55, may preferably consists of two locking strips 61. These locking strips 61 will be described in details after the next preferred embodiment.

Optionally, according to a particularly preferred embodiment of the invention, the sign board 51 is further provided with:

a base 63 having a top surface 65 and being adapted to be positioned on a substantially horizontal surface or element in order to keep the flat body 53 in a substantially vertical position; and means for fastening the top surface 65 of the base 63 with the lower end of the flat body 53. More particularly, these means consists of two pairs of parallel shoulders 67,73.

Each shoulder 67 of a first pair of shoulders are spaced apart from each other and are located on opposite faces of the flat body 53. Advantageously a lower part of the flat body 53 is divided into two walls 69 whose a lower portion thereof are substantially parallel to each other and spaced apart from each other. In that case, the outer face of each wall 69 is provided with a rib 71 whose at least a part thereof defines one shoulder 67.

Each shoulder 73 of the second pair of shoulders are spaced apart from each other and provided on a pair of substantially parallel walls integrally extending above the top surface 65. Advantageously, the top surface 65 of the base 63 is defined by the bottom of a groove having two lateral wall 75 which define said pair of parallel walls integrally extending from and above the top surface 65. Each lateral wall is provided with a rib 77 whose at least a part thereof defines one shoulder 73.

Each shoulder 67 is intended to be engageable against and slidable (according to arrow c in FIGS. 1 and 5) on a corresponding shoulder 73 when the lower end of the flat body 53 (especially of walls 69) is(are) engaged against the top surface 65 and is (are) slidable on the top surface 65.

Advantageously, according to an optionally preferred embodiment, the flat body 53 is made of elastically deformable material and each rib 71 and 77 is further provided with bevelled surfaces 72 and 78 that are opposite the corresponding shoulders 67,73. Thus, when the lower end of the flat body 53 is pushed toward the top surface 65, each surface 72 slide over a corresponding surface 78 to cause walls 69 to be disformed one toward the other until shoulders 67 is positioned slightly lower than shoulders 73, when the lower end of walls 69 abut against the top surface 65. The elasticity of the material defining the flat body 53 causes walls 69 to return its original position and to position shoulders 67 underneath and preferably against shoulders 73.

Figure 6:
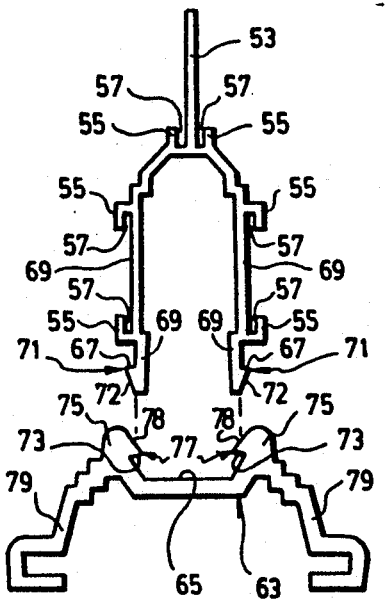
FIG. 6 is an end elevational view of the lower end of a sign board (without the locking strip, containers and sheets) and of a base (first preferred embodiment)

According to a first variant, as illustrated in FIGS. 1 and 6, the base 63 may be provided with legs 79 adapted to rest on a substantially horizontal surface such as a table or desk surface. Of course, the shape of legs is not essential. However, because the base 63 is advantageously made of plastic material and that it can be obtained advantageously by moulding and preferably by extrusion through a die, the illustrated shape of legs 79 is particularly preferred.

Figure 7:
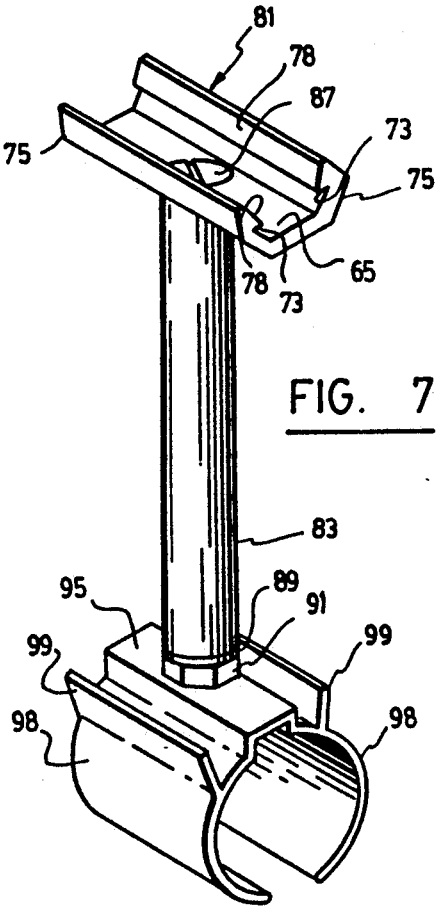
FIG. 7 is a perspective view of the base shown in FIG. 5.
Figure 8:
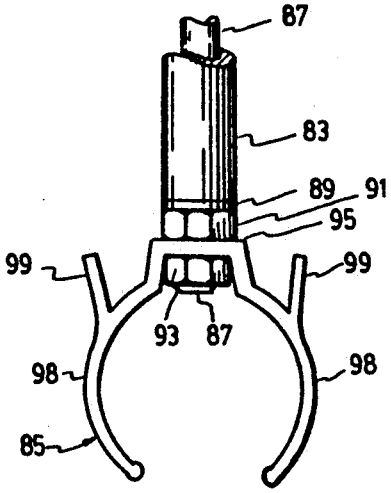
FIG. 8 is a partial end view of the lower part of the base of FIG. 7.

According to a second variant, as illustrated in FIGS. 5, 7 and 8, a base 81 (which is identical to the base 63 except legs 79 are missing) and a pincer 85 are connected together by any appropriate means such as a stem. Preferably, the pincers 85 comprises two arcuated jaw 98 joined together by a short plate 95. The item consist of a threaded bolt 87 having a flat head and passing through and engaging a bore provided in the base 81, passing through the sleeve 83, a washer 89 (especially a lock washer), a first nut 91, a bore provided in the plate 95 and a second nut 93. The nut 91 is screwed on the bolt 87 to tighten the sleeve 83 against the base 81, the nut 93 is screwed to tighten the plate 95 between nuts 91,93.

The pincer 83 is intended to fit on an element such as a cylindrical pole 97, especially a pole of the type existing in a rack and on which clothes are suspended with hangers. Preferably, each jaw 98 may be provided with a wing 99. When wings 99 are pressed (e.g. with fingers) one toward the other, jaws are moved away from each other to make easier the positioning or the removal of the pincer on or from the pole 97. The pincer 85 is preferably made of elastically deformable material, and more particularly of any suitable plastic material having this property. The base, the stem, the bolt, the washer, the nuts and the pincers may be each made of elastically deformable plastic material, and may be obtained by moulding or by extrusion through a die. The bolt, the nuts and the washer may also be made of any appropriate metal (e.g. steel).

Each locking strip 61 may consist of an elongated member 121 provided with tongues 123 spaced apart from each other by a groove 125, of tongues 127 spaced apart from each other and of a tongue 129 substantially perpendicular with a longitudinal axis of the member 121. Each tongue 123 or 127 is intended to be positioned between a corresponding pair of guiding bars 55 while the flat body 53 is inserted in the groove 125. The tongue 129 is positioned between walls 69. Each locking strip 61 is advantageously held on the flat body 53 by a friction existing between tongues 123, 127, 129 and the flat body 53. Thus, tongues 123, 127 and 129 are preferably sized and positioned on the strip 61 to engage by friction the flat body 53.

Figure 9:
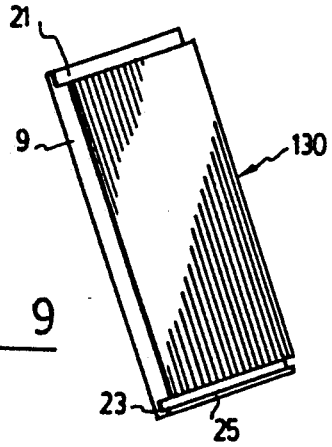
FIG. 9, which appears on the second sheet of drawings, is a perspective view of a spacer.

Between at least one pair of guiding bars 55 having a determined length, and preferably one pair of guiding bars 55 on both faces of the flat body 53, one or several containers 1 (preferably 4 containers 1 on both faces of the flat body 53) can be positioned. When a number of containers 1 is insufficient to fill all the space available between a pair of guiding bars 55, spacers 130 (see FIG. 9) may be used. These spacers 130 are similar to container 1 except they are not provided with a window and they are half wide. Thus, it is possible to center three containers 1 by positioning two half wide spacer 130 at both end of a row of containers 1.

For each locking strip 61, one pair of tongues 123 (see FIGS. 1 and 5) abuts against a corresponding sidewall 9 of a neighboring container 1 or spacer 130 to lock said container 1 between guiding bars 55 and corresponding tongues 123 of each locking strip 61. Also, stacks of sheets 59 and 101 are locked between grooves 57 of corresponding guiding bars 55 and the other tongues 123 and tongues 127.

Optionally, the top of the flat body 53 may be provided with a pair of elastically deformable lips 131 intended to pinch a display sheet 133. This sheet is inserted or removed by any appropriate means.

Advantageously, the flat body 53, guiding bars 55, walls 69, ribs 71 and lips 131 are integral to each other and are obtained by extrusion of an elastically deformable plastic material through an appropriate die.

In order to use a sign board 51 according to the invention, one of said locking strips 61 is manually removed from the flat body 53, and, for each face of flat body 53, containers 1 are slid out from the grooves 57 of the corresponding pair of bars 55. Then, for each container 1 the appropriate display sheet 15 is put in the foremost position of the stack of display sheets 15 according to the procedure described hereinabove. If desired, the appropriate display sheets 59 and 101 are also put in the foremost position of their corresponding stack. Then tongues 21,23 are inserted in grooves 57 with the skid 25 in the groove 57 of the lower corresponding bar 55. If the number of containers 1 is not sufficient to fill the whole row defined by guiding bars 55, two spacers 130 may be inserted to center containers 1. Then the locking strip 61 is manually positioned on the flat body 53 until tongues 123 abuts a neighboring container 1 or spacers 130 and tongues 123 and 125 abuts the stack of sheets 59,101.

In order to fasten a base 63 or 81 with the lower part of the flat body 53, either shoulders 67 are slid against and over shoulders 73 and the lower end of walls 69 are slid against and over the top surface 65 according to arrow c, or bevelled surfaces 72 are slid over bevelled surface 78 to cause walls 69 to be disformed one toward the other until shoulders 67 be positioned slightly lower than shoulders 73, when the lower end of walls 69 to abut against the top surface 65. The elasticity of the material defining the flat body 53 causes walls 69 to return its original position and to position shoulders 67 underneath and preferably against shoulders 73.

To unfasten the base 63 or 81 from the lower part of the flat body 51, shoulders 67 are slid against and over shoulders 73 and the lower end of walls 69 are slid against and over the top surface 65 according to arrow c.

To clip or unclip the pincer 83 on a pole 97, either jaws are simply forced over said pole 97, or jaws are moved away from each other when wings 99 are moved toward each other when pressed (e.g. with fingers), or a combinaison of both aforesaid possibilities.

Of course, the above described invention also relates to any variations thereof, that would be obvious to one ordinary skilled in the art.

What is claimed is:

1. An improved sign board assembly comprising:

a flat body provided with at least one pair of guiding bars that are spaced apart and substantially parallel to each other, and have a part thereof spaced apart from one face of the body, and another part thereof connected with that face of the body, in order to define a pair of grooves facing to each other;

one or several containers, each container being of the type comprising:

a substantially flat rear wall, and side walls connecting together a front wall and the rear wall to position them at a distance from each other and define a pocket;

an access opening to the pocket positioning between the front and the rear walls;

a stack of individual display sheets, said display sheets are all of the same size, conforming with a size of the pocket, said stack being insertable in the pocket and removable from the pocket through said access opening, a foremost display sheet of the stack being visible through a window in one of said walls while the other display sheets of the stack are hidden from view by the foremost display sheet, all the display sheets of said stack being interchangeable, so that any selected display sheet of such stack can be positioned in foremost position;

wherein means for engaging the stack of display sheets inside the pocket are provided in order to prevent said sheets from accidentally slipping out from the pocket through the access opening;

each of said containers being sized to have parts thereof slidable between the flat body and the pair of guiding bars, and have at least a part thereof supported on a lower guiding bar of said pair of guiding bars;

means for selectively preventing said containers to slide between the flat body and the guiding bars, to thus removably lock them in position on a corresponding face of the flat body;

a base having a top surface and being adapted to be positioned on a substantially horizontal surface or element in order to keep the flat body in a substantially vertical position; and means for fastening the top surface of said base with a lower end of the flat body, wherein said means consist of two pairs of substantially parallel shoulders, each shoulder of a first pair of shoulders being spaced apart from each other and located on opposite and substantially parallel faces of the flat body near the lower end thereof, while each shoulder of a second pair of shoulders are spaced apart from each other and located on a pair of substantially parallel walls integrally extending above the top surface of the base, each shoulder of the first pair of shoulders being intended to be engageable against and slidable over a corresponding shoulder of the second pair of shoulders, when the lower end of the flat body is engaged against and slidable over the top surface of the base.

2. A sign board according to claim 1, wherein the lower end of the flat body comprises a pair of two integral and substantially parallel walls spaced apart from each other and each provided on their outer surface with a rib whose at least a part thereof defines a shoulder of the first pair of shoulders, wherein the top surface of the base is defined by a bottom of a groove having two lateral walls, said lateral walls defining said pair of parallel walls integrally extending above the top surface and being each provided with a rib whose at least a part thereof defines a shoulder of the second pair of shoulders.

3. A sign board according to claim 2, wherein the flat body is made of elastically deformable material, wherein each rib provided with a shoulder is further provided on a part thereof opposite the shoulder, with a bevelled surface oriented in such a way that said bevelled surfaces of ribs of the first pair of shoulders match with bevelled surfaces of ribs of the second pair of shoulders, and when the flat body is pushed toward the top surface of the base, each bevelled surfaces of the ribs of the first pair of shoulders is allowed to slide over the bevelled surfaces of the ribs of the second pair of shoulders causing the substantially parallel walls of the flat body to be deformed one toward the other, until shoulders of the first pair of shoulders are positioned slightly lower than the corresponding shoulders of the second pair of shoulders, when a lower end of saids two substantially parallel walls of the flat body abut against the bottom of the groove, the elasticity of the material defining the flat body causing the substantially parallel walls of said flat body to position shoulders of the first pair of shoulders underneath the corresponding shoulder of the second pair of shoulders.

4. A sign board according to claim 1, wherein the base is further provided with a pair of pincer adapted to be clipped on an horizontal pole.

* * * * *